United States Patent [19]

Dahl

[11] Patent Number: 4,753,027

[45] Date of Patent: Jun. 28, 1988

[54] SIGN HOLDER

[75] Inventor: Terence W. Dahl, Seattle, Wash.

[73] Assignee: Thomas Machine & Foundry, Inc., Lynnwood, Wash.

[21] Appl. No.: 870,103

[22] Filed: Jun. 3, 1986

[51] Int. Cl.[4] ..... G09F 15/00

[52] U.S. Cl. ..... 40/611; 40/618

[58] Field of Search ..... 40/606, 607, 597, 611, 40/618

[56] References Cited

U.S. PATENT DOCUMENTS

| | | | |
|---|---|---|---|
| 2,372,387 | 3/1945 | Morin | 40/606 |
| 2,935,804 | 5/1960 | Dackro | 40/10 R |
| 3,183,613 | 5/1965 | Rojc | 40/10 R |
| 3,969,838 | 7/1976 | Moore | 40/611 |

FOREIGN PATENT DOCUMENTS

| | | | |
|---|---|---|---|
| 2477307 | 9/1981 | France | 40/607 |
| 161299 | 12/1979 | Japan | 40/10 R |
| 5150 | 3/1906 | United Kingdom | 40/611 |
| 1386420 | 3/1975 | United Kingdom | 40/10 R |
| 2130420 | 5/1984 | United Kingdom | 40/606 |

*Primary Examiner*—Henry E. Raduazo

*Attorney, Agent, or Firm*—Seed and Berry

[57] ABSTRACT

A sign holder having a substantially transparent, flexible cover which is closely received in a base. The cover is removed from the base by flexing the cover to free the ends of the cover from pockets on the base. The sign is positioned between a mounting surface of the base and the cover. Air channels are provided in the base and the walls forming the pockets to prevent the formation of a vacuum when water enters the interface between the cover and the base, while inhibiting external access by vandals.

12 Claims, 2 Drawing Sheets

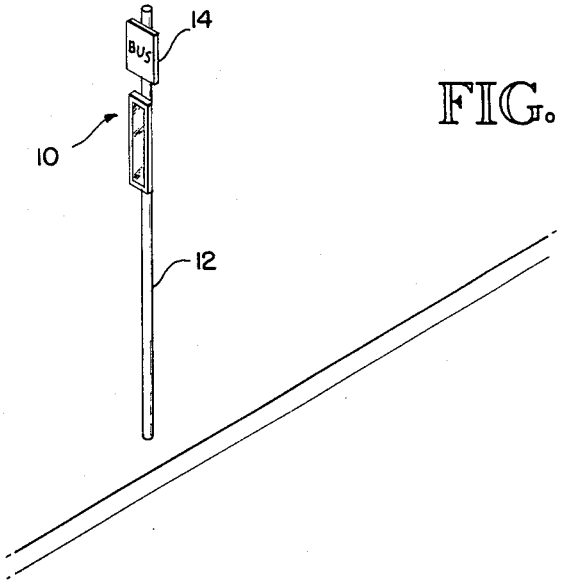
FIG. 1
FIG. 2
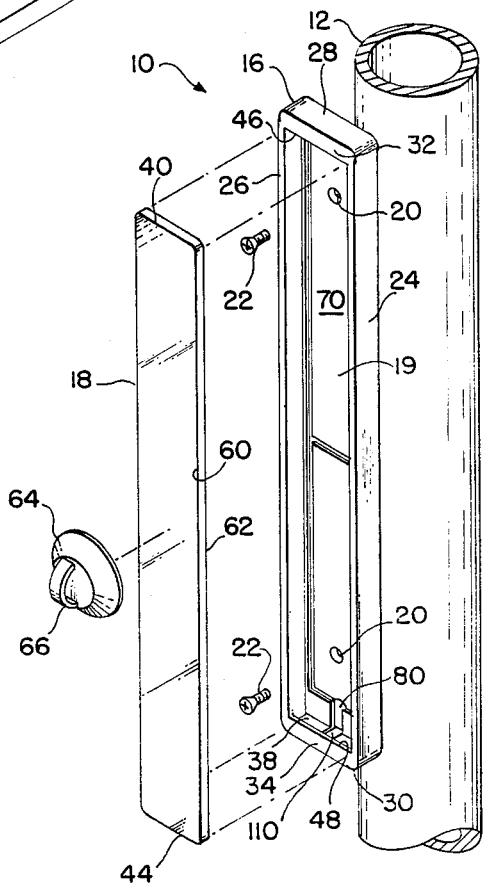
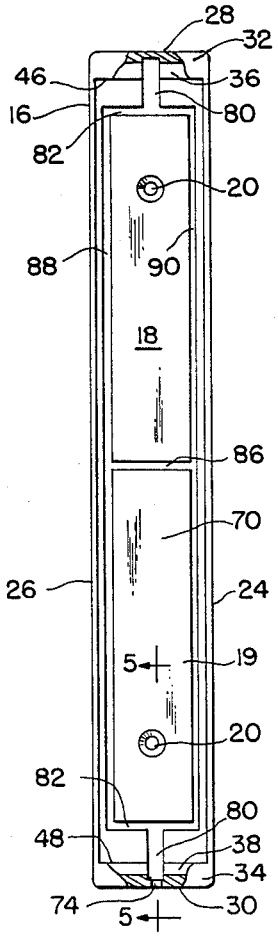
FIG. 3

FIG. 4
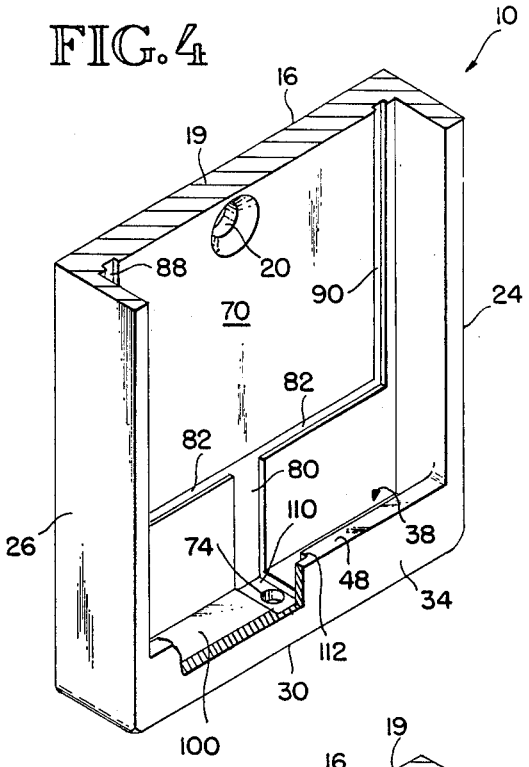
FIG. 5
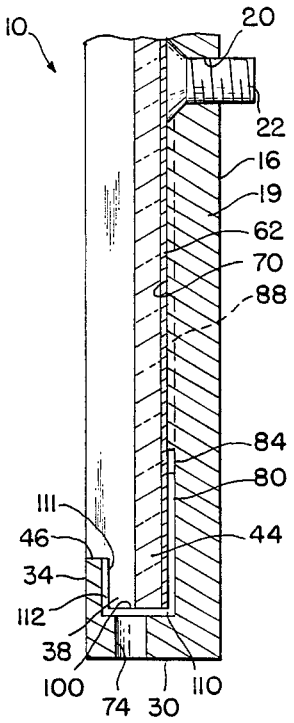
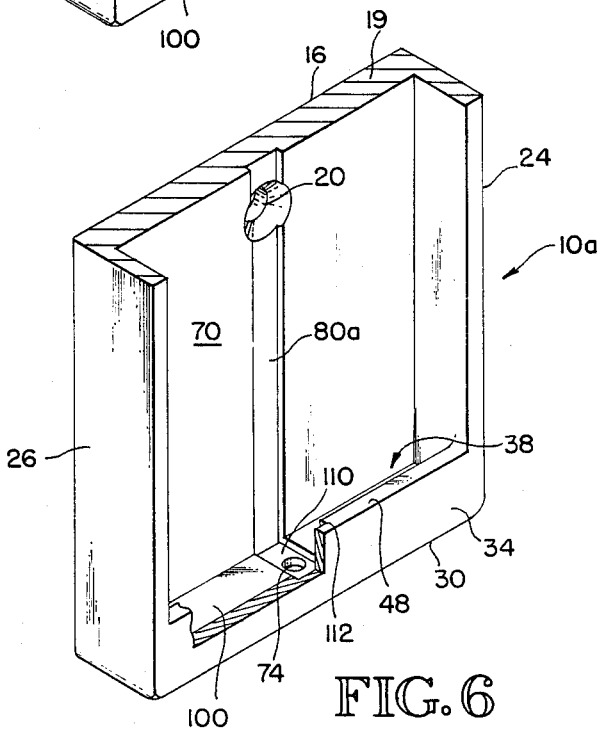
FIG. 6

SIGN HOLDER

TECHNICAL FIELD

The invention relates to outdoor sign holders for removably receiving a sign. More specifically, the invention relates to sign holders of the type having a clear, flexible cover which is received in a base. The base has a supporting surface for the sign.

BACKGROUND ART

Displaying printed sheet materials outdoors presents particular problems in protecting the displayed material from weather and vandalism. Especially where time-dated material is displayed, a holder for displaying the material must releasably support the printed material in a manner so that the material can be regularly replaced with updated material, and must protect the material. Vandalism is a particularly acute problem where printed materials are displayed in public areas. Bus schedules, for example, must be displayed at or near bus stops, typically in areas unguarded and unprotected from the weather. The sign holder which holds the bus schedule sheet must not only protect the schedule sheet from the whether, but must also discourage attempts to dislodge the schedule sheet from the holder or to mutilate the schedule sheet.

A variety of sign holders have been developed to alleviate these problems. In one design, a sign holder has walls which are grooved to slidably receive a clear face plate. Bolts secure the face plate to the sign holder so that the face plate can only be removed by first removing the bolts. The sheet material is sandwiched between the face plate and the holder. A particular problem with this type of holder is that the bolts are troublesome to handle and can be easily dropped, or misplaced. Furthermore, the type of tool required to remove the bolts is often a standard household tool, providing little security against unauthorized removal of the cover.

Another type of sign holder has been devised which utilizes a clear, flexible cover plate which is received in a base. The base is adapted to be mounted on a vertical pole or other surface. The base has side walls which extend outward from a back wall and are sized to closely receive the cover plate therebetween. The printed sheet material is positioned sandwiched between the back wall and the clear cover plate. The ends of the base have end flanges which define pockets to receive the ends of the cover plate. The base is dimensioned such that the cover plate can only be inserted or removed from the base if the cover plate is flexed into a bow shape to reduce the effective overall length of the cover plate and allow at least one of its ends to clear the corresponding end flange forming one of the pockets. When the flexing force is removed from the cover plate, the cover plate relaxes and resumes its original length and planar shape. When inserted in the base and then relaxed, the ends of the cover plate are retained in the pockets by the flanges. The cover plate is manufactured of a relatively rigid, but yet somewhat flexible clear plastic which requires a person to apply a sufficient force to bow the cover plate to remove it from the base that it is difficult to do without special tools. Because the edges of the cover plate are closely received by the sidewalls of the holder and because the ends of the cover are retained within the pockets, it is difficult or impossible to pry the cover from the base with conventional household tools.

The primary method for removing the cover plate is to depress a suction cup against the smooth front face of the cover plate and pull it outwardly. This causes the cover to flex into an outward bowed shape which frees at least one end of the cover plate from its corresponding pocket in the base. Once one end of the cover plate is free, the cover plate can be separated from the base and a sheet sign, such as a paper bus schedule, can be inserted flat against the back wall of the base. To replace the cover, one end of the cover plate is inserted in one pocket while a suction cup and a free hand are used to pull outward against the center and push inward against the freeend of the cover plate, respectively, to bow the cover sufficiently for the free end of the cover plate to clear the other flange in preparation for insertion into the flange forming the pocket. The force on the cover plate is then relieved so that it relaxes and returns to its original planar shape with both ends retained within their respective pockets. Because suction cups are not common household tools, this type of sign holder has proved to be substantially tamper proof.

A serious problem with the above type of sign holder, however, is that water tends to collect in the interface between the cover plate and the back wall and displaces air in the interface, thus causing a vacuum to be formed. Once the vacuum is formed, it becomes extremely difficult even with a suction cup to apply enough outward force on the cover plate to bow the flexible cover plate away from the back wall in order to free one end of the cover plate from its pocket. It has also been found that the problem is particularly acute when the sheet material positioned between the cover plate and back wall is made of a paper, which tends to absorb and wick water into the interface between the cover and base.

DISCLOSURE OF THE INVENTION

In its broadest terms, the invention comprises a sign holder which has a base, a substantially transparent flexible cover with a substantially planar rear surface to position a sign therebetween, and means for communicating air to the interface between the base and cover. The base has sidewalls which are spaced aprt to closely receive the cover. The base also has two end walls with flanges which form pockets for receiving the ends of the cover. The base has a channel which communicates with the interface between the base and the cover rear surface and communicates with the atmosphere to provide air to the interface. The channel prevents the formation of a vacuum between the cover and the base, and allows the cover to be removed in the conventional manner by pulling the center of the cover away from the base. This bows the cover and frees at least one end of the cover from its pocket.

In a preferred embodiment of the invention, the channel in the base extends from a central area of the interface between the base and the cover rear face to an edge of the base at an end wall. The end wall and flanges also have channels which communicate with the channel on the base mounting surface. Additional channels, which are in full communication with the above-mentioned channels can be provided in the base mounting surface to expose other areas of the interface to the atmosphere.

BRIEF DESCRIPTION OF THE DRAWINGS

FIG. 1 is an isometric view of a sign holder of the present invention adapted for displaying bus schedules and mounted vertically on a bus stop sign post.

FIG. 2 is an exploded, enlarged isometric view of the sign holder shown in FIG. 1.

FIG. 3 is an enlarged front elevational view of the sign holder of FIG. 1.

FIG. 4 is an enlarged, fragmentary, sectional view of the sign holder of FIG. 1.

FIG. 5 is an enlarged, fragmentary, sectional view taken generally along line 5—5 of FIG. 3.

FIG. 6 is an enlarged, fragmentary, sectional view of a second embodiment of the sign holder of FIG. 1.

BEST MODE FOR CARRYING OUT THE INVENTION

In FIG. 1, a sign holder in accordance with the present invention, is generally indicated at reference numeral 10. The sign holder is vertically oriented and attached to a pole 12 which supports a bus stop sign 14. This figure illustrates one contemplated application for the invention, which is displaying bus schedules at outdoor bus stops. It is to be understood that the sign holder of the present invention is applicable to a variety of other uses and not limited to displaying bus schedules or schedules in general. The sign holder is believed to be particularly useful for displaying any type of sheet sign material which is to be replaced on a regular basis and which may be exposed to rain, snow or other environmental conditions. The sign holder is particularly resistant to unauthorized removal or mutilation of the sign contained in the holder.

As shown in FIG. 2, the sign holder 10 has a base 16 which is designed to receive an elongated, substantially transparent, flexible plate cover 18. The base has a back wall 19 which is provided with holes 20 to permit the base to be secured to the pole 12 with screws, rivets or other fasteners 22 as may be desired. The base has two longitudinally extending and parallel side walls 24 and 26 which are spaced apart and project perpendicularly outward from the back wall to closely receive the cover 18 therebetween. A paper sheet sign 27 is located in juxtaposition between the cover and the base back wall (see FIG. 5).

As best seen in FIGS. 3, 4 and 5, the longitudinal ends of the base 16 have two longitudinally extending and parallel end walls 28 and 30 which are spaced apart and project perpendicularly outward from the back wall to closely receive the cover 18 therebetween. The distance between the base end walls is slightly larger than the length of the cover 18 when in its normal planar shape. Attached to each of the end walls 28 and 30 is a flange 32 and 34, respectively, which projects perpendicularly therefrom toward the other flange to form a pair of pockets 36 and 38 for receiving the opposite ends 40 and 44 of the cover 18.

The flexible cover 18 has a longitudinal length greater than the distance between the edges 46 and 48 of the flanges 32 and 34, respectively. The longitudinal edges of the cover 18 are thus closely received between the sides 24 and 26 of the base 16, and the ends 40 and 44 are received in the pockets 36 and 38, with the flanges 32 and 34 overlaying the cover ends 40 and 44. The relatively close fit between the longitudinal edges of the cover and the base side walls, and the flanges overlaying the cover ends, discourages insertion of prying implements which might be used to separate the cover from the base to expose the sign 27 held therebetween.

The cover 18 has a substantially smooth, planar front surface 60, making it difficult for an unauthorized person to grasp the cover and remove it from the base 16. The preferred method for removing the cover from the base is by applying a suction cup 64 (see FIG. 2) to approximately the center of the front surface 60 of the cover 18. A handle 66 on the suction cup is provided for grasping by the user for pulling the cover outward, generally perpendicularly away from the base back wall. The flexible nature of the cover causes the cover to bow outward along its length away from the base 16. The distance between the ends 40 and 44 of the cover is thus effectively reduced and the ends can be freed from the pockets 36 and 38. Because suction cups having the necessary gripping power to bow the cover are not common household tools, unauthorized removal of the cover by this method is less likely to occur.

It has been discovered, however, that because of the relatively tight fit between the cover 18 and the base 16, under certain conditions a vacuum is formed therebetween which prevents or makes extremely difficult removal of the cover 18 from the base in the described manner. This is particularly a problem if the sign 27 is made of a somewhat absorbent paper. The cover has a smooth planar back surface 62 which is in juxtaposition with the base back wall 19, with the sheet sign 27 positioned therebetween. Water from rain or melting snow tends to enter the interface between the smooth back surface 62 of the cover and a substantially planar outward facing mounting surface 70 of the base back wall 19. The water generally enters from around the edges of the cover. It is believed that water in the interface displaces air by capillary action, forming a vacuum between the cover 18 and the base 16. Because the area of the vacuum (approximately the surface area of the cover 18) is substantially greater than the force applying area of the suction cup 64, it is virtually impossible to remove the cover.

To introduce air into the interface in order to break the vacuum by allowing the formation and growth of an air bubble beneath the central portion of the cover 60 as the cover is pulled outward and away from the base back wall, the base mounting surface 70 is provided with longitudinally extending air channels 80 at each end which are each connected to a transversely extending air channel 82. A third transverse air channel 86 is centrally located in the base mounting surface 70 and is connected to the transverse channels 82 by a pair of spaced apart, longitudinaly extending channels 88 and 90.

The end walls 28 and 30 and the flanges 32 and 34 are also provided with channels fluidly connected to the mounting surface channel 80 and to the atmosphere, to provide a passage for entry of air around the ends 40 and 44 of the central portion of the cover 18 to break the vacuum in the interface as the cover 18 is bowed away from the base to remove it. As shown in FIG. 4 and for one end of the base 16, the inner surface 100 of the end wall 30 has a centrally located channel 110 which is connected to the channel 80 in the base mounting surface 70. The end wall 30, since it is at the lower end of the sign holder 10, is provided with a water drain hole 74 to drain away the water which would otherwise accumulate in the lower pocket 38. The channel 110 extends across the drain hole.

The flange 34 also has a centrally located channel 112 which has one end connected to the channel 110 on the inner surface 100 of the end wall 30. The free end of channel 112 extends to the edge 46 of the flange to provide an unobstructed passage for air through the system of channels. It has been found that by placing these channels on the inside surfaces of the end walls and flanges, the temptation to insert prying implements into the holder is minimized. Identical structure is provided in the end wall 30 and the flange 32 of the base.

The depth of the channel is not considered to be particularly critical so long as an unobstructed air passage is formed from the atmosphere to the interface between the mounting surface 70 and the back surface 62 of the cover 18 perferably along the full length of the cover, and particularly at the central portion of the cover. It is noted that the holes 120 in the base back wall 19 are filled and substantially sealed by the fasteners 22, thus providing little if any air. Furthermore, the provision of holes in the back wall to relieve the vacuum is unsatisfactory, since the holes provide a vandal with an easy opportunity to insert a small object (such as a nail) therethrough and damage the sign 27 or push the cover outward from behind to remove it from the base.

FIG. 6 shows an alternate embodiment of the sign holder 10*a* in which a channel 80*a* extends the full length of the base 16 between the channels 110 in the end walls 28 and 30. The transverse tributaries have been omitted. In all other respects, the embodiment of FIG. 6 is identical to the first embodiment of the invention.

The described structures for venting the interface between the cover 18 and the base 16 have been found to adequately overcome the problem caused by displacement of air by water in the interface between the cover 18 and base 16. Alternate methods of venting the area, such as perforating the base or cover are less satisfactory because they invite vandalism by providing access to the sign with a poking instrument.

Other than the air channel arrangement described above, the general construction of the cover 18 and base 16 are well known to those skilled in the art. The cover is preferably manufactured from a substantially clear acrylic or polycarbonate material. In the embodiment shown in the figures, the cover has a length of approximately 21 7/16 inches, a width of 2⅝ inches and a thickness of ¼ inch. The distance between the edges 46 and 48 of the flanges 32 and 34 is approximately 20 13/16 inches. The distance between the inner surfaces of the end wall 28 and 30 is approximately 21 13/16 inches. The distance between the sidewalls 24 and 26 is approximately 2⅝ inches. The suction cup used to remove the cover has a diameter of approximately 2¼ inches.

The base 16 can be manufactured from aluminum and cast in a sand mold. The pockets 36 and 38 are achieved by using cores during the casting process. The cores are manufactured from silicon sand which has been electrostatically coated with phenolic resin. The channels can be molded or machined in the base back wall.

As will be appreciated by those skilled in the art, the embodiments of the invention disclosed above are only two of many contemplated variations of the invention. For example, the channels in the mounting surface 70 of the base could be replaced by suitable roughening of the surface which would be sufficient to prevent swollen, water-logged paper from blocking the passage of air to the central portion of the interface. Therefore, the invention is not to be limited by the above description, but is to be determined in scope by the claims which follow.

I claim:

1. An improved sign holder of the type having a base receiving a flexible, transparent elongated cover having substantially planar front and rear faces for positioning a sheet sign therebetween, the cover having an end portion at each lengthwise end, the base being of the type which has a substantially planar mounting surface for mounting the sign thereagainst, two side walls projecting outward from the mounting surface and spaced apart to closely receive the cover therebetween, and two spaced apart end walls, each end wall having and end wall portion projecting outward from the mounting surface and a flange, the end wall flanges being spaced outward from the base mounting surface and projecting toward each other and each terminating in a free inward edge to form receiving pockets for the corresponding end portions of the cover, wherein the base mounting surface between the end wall portions is planar for substantially the full length of the cover and the length of the cover is greater than the distance between the flange inward edges and substantially equal to the distance between the end wall portions so that the cover is closely received between the end wall portions and the cover end portions are positioned under the end wall flanges, whereby the cover cannot be removed by tilting without substantial bending the cover and the method for removal of the cover when placed against the mounting surface with the cover end portions between the end wall flanges and the mounting surface is to pull outward on the cover with a removable suction cup, causing the cover to flex and at least one cover end portion to and clear the free inward edge of the corresponding end wall flange, the improvement comprising:

a vent air channel in the base mounting surface having an end positioned at an edge of the cover lengthwise end portion and unobstructed by the cover when in place against the mounting surface, and communicating with the atmosphere, the channel including a portion extending to a central area of the interface between the base mounting surface and the cover rear face to prevent the formation of a vacuum in the interface and facilitate removal of the cover.

2. The improved sign holder of claim 1, the improvement further including a first end wall channel in an inward surface of at least one of the end wall portions, wherein the first end wall channel has a first end fluidly connected to the end of the vent channel and a second end communicating with the atmosphere.

3. An improved sign holder of the type having a base receiving a flexible, transparent elongated cover having substantially planar front and rear faces for positioning a sheet sign therebetween, the cover having an end portion at each lengthwise end, the base being of the type which has a substantially planar mounting surface for mounting the sign thereagainst, two side walls projecting outward from the mounting surface and spaced apart to closely receive the cover therebetween, and two spaced apart end walls, each end wall having an end wall portion projecting outward from the mounting surface and a flange, the end wall flanges being spaced outward from the base mounting surface and projecting toward each other and each terminating in a free inward edge to form receiving pockets for the corresponding end portions of the cover, wherein the length of the cover is greater than the distance between the flange inward edges and substantially equal to the distance between the end wall portions so that the cover is closely received between the end wall portions and the cover end portions are positioned under the end wall flanges, whereby the method for removal of the cover when placed against the mounting surface with the cover end portions between the end wall flanges and the mounting surface is to pull outward on the cover with a removable suction cup, causing the cover to flex and at least one cover end portion to and clear the free inward edge of the corresponding end wall flange, the improvement comprising:

a vent air channel in the base mounting surface having an end positioned at an edge of the cover lengthwise end portion and unobstructed by the cover when in place against the mounting surface, and communicating with the atmosphere, the channel including a portion extending to a central area of the interface between the base mounting surface and the cover rear face to prevent the formation of a vacuum in the interface and facilitate removal of the cover, a first end wall channel in an inward surface of at least one of the end wall portions, wherein the first end wall channel has a first end fluidly connected to the end of the vent channel and a second end communicating with the atmosphere, and a second end wall channel in an inward surface of at least one of the end wall flanges, wherein the second end wall channel has a first end fluidly connected to the second end of the first end wall channel and a second end communicating with the atmosphere.

4. An improved sign holder of the type having a base receiving a flexible, transparent elongated cover having substantially planar front and rear faces for positioning a sheet sign therebetween, the cover having an end portion at each lengthwise end, the base being of the type which has a substantially planar mounting surface for mounting the sign thereagainst, two side walls projecting outward from the mounting surface and spaced apart to closely receive the cover therebetween, and two spaced apart end walls, each end wall having an end wall portion projecting outward from the mounting surface and a flange, the end wall flanges being spaced outward from the base mounting surface and projecting toward each other and each terminating in a free inward edge to form receiving pockets for the corresponding end portions of the cover, wherein the length of the cover is greater than the distance between the flange inward edges and substantially equal to the distance between the end wall portions so that the cover is closely received between the end wall portions and the cover end portions are positioned under the end wall flanges, whereby the method for removal of the cover when placed against the mounting surface with the cover end portions between the end wall flanges and the mounting surface is to pull outward on the cover with a removable suction cup, causing the cover to flex and at least one cover end portion to and clear the free inward edge of the corresponding end wall flange, the improvement comprising:

a vent air channel in the base mounting surface having an end positioned at an edge of the cover lengthwise end portion and unobstructed by the cover when in place against the mounting surface, and communicating with the atmosphere, the channel including a portion extending to a central area of the interface between the base mounting surface and the cover rear face to prevent the formation of a vacuum in the interface and facilitate removal of the cover, the channel portion including a transversely extending channel and a pair of laterally spaced apart, longitudinally extending channels in the base mounting surface fluidly connected to the transverse channel.

5. The improved sign holder of claim 4, wherein the vent channel further includes a longitudinal extending end channel in the base mounting surface fluidly connected to the transverse channel and communicating with the atmosphere.

6. An improved sign holder of the type having a base receiving a flexible, transparent elongated cover having substantially planar front and rear faces for positioning a sheet sign therebetween, the cover having an end portion at each lengthwise end, the base being of the type which has a substantially planar mounting surface for mounting the sign thereagainst, two side walls projecting outward from the mounting surface and spaced apart to closely receive the cover therebetween, and two spaced apart end walls, each end wall having an end wall portion projecting outward from the mounting surface and a flange, the end wall flanges being spaced outward from the base mounting surface and projecting toward each other and each terminating in a free inward edge to form receiving pockets for the corresponding end portions of the cover, wherein the length of the cover is greater than the distance between the flange inward edges and substantially equal to the distance between the end wall portions so that the cover is closely received between the end wall portions and the cover end portions are positioned under the end wall flanges, whereby the method for removal of the cover when placed against the mounting surface with the cover end portions between the end wall flanges and the mounting surface is to pull outward on the cover with a removable suction cup, causing the cover to flex and at least one cover end portion to and clear the free inward edge of the corresponding end wall flange, the improvement comprising:

a vent air channel in the base mounting surface having an end positioned at an edge of the cover lengthwise end portion and unobstructed by the cover when in place against the mounting surface, and communicating with the atmosphere, the channel including a portion extending to a central area of the interface between the base mounting surface and the cover rear face to prevent the formation of a vacuum in the interface and facilitate removal of the cover, the channel portion including a longitudinally extending channel in the base mounting surface extending substantially completely between the end walls.

7. The improved sign holder of claim 5, wherein the vent channel further includes a central transversely extending channel in the base mounting surface positioned substantially midway between the end walls and fluidly connected to each of the longitudinal channels.

8. A tamper-resistant sign holder for removably holding a sheet sign, comprising:

a substantially transparent, flexible elongated cover having substantially planar front and rear surfaces and and an end portion at each lengthwise end thereof; and a base for removably receiving the cover with the sign positioned between a substantially planar mounting surface and the cover, wherein the mounting surface has a first channel formed therein extending to a central area of the interface between the mounting surface and the cover rear surface, a pair of side walls projecting outwardly from the mounting surface, a pair of end walls each with an end wall portion and a flange connected thereto, the end wall portions projecting outwardly from the base mounting surface and spaced apart to closely receive the cover lengthwise ends therebetween, the flanges being spaced from the base mounting surface and projecting toward each other and each terminating in a free inward edge and forming a receiving pocket for the corresponding cover end portion, the cover having a length greater than the distance between the flange inward edges and substantially equal to the distance between the end wall portions, at least one of the end walls having a second channel formed in its end wall portion and fluidly connected to the first channel, and a third channel formed in its flange and fluidly connected to the second channel and communicating with the atmosphere, the first, second and third channels being unobstructed to the free flow of air therethrough by the cover when in place against the mounting surface to prevent the formation of a vacuum in the interface.

9. The sign holder of claim 8, wherein the first channel includes a transversely extending channel portion.

10. The sign holder of claim 9, wherein the first channel further includes a longitudinally extending channel portion fluidly connected to the transverse channel.

11. The sign holder of claim 8, wherein the first channel includes a longitudinally extending channel portion extending substantially between the end walls.

12. A tamper-resistant sign holder for removably holding a sign, comprising:

a planar, substantially transparent, flexible elongated cover having an end portion at each lengthwise end thereof;

a base for removably receiving the cover, having two side walls spaced apart to closely receive the cover therebetween, two end walls spaced apart to closely receive the cover therebetween, and a substantially planar mounting surface extending substantially the distance between the side walls and the end walls for positioning a rear surface of the cover in juxtaposition and against the mounting surface along substantially the full length of the cover with the sign positioned therebetween, the base further including a flange connected to each end wall and extending substantially toward the flange of the opposite end wall and terminating in an inward edge to overlay the corresponding end portion of the cover when the cover is in place against the mounting surface, each flange being positioned sufficiently spaced away from the mounting surface to receive the corresponding end portion of the cover between the flange and the mounting surface, the flanges extending toward each other with a sufficiently small distance between the inward edges of the flanges that removal of the cover under normal operating conditions when in place against the mounting surface requires substantial flexing of the cover along its length before one of the cover end portions clears the inward edge of the corresponding flange; and an air channel in the base mounting surface extending from a central area of the mounting surface to at least one of the end walls and terminating in a channel end portion under the corresponding flange outwardly of the corresponding cover end portion to communicate air from atmosphere to the interface between the base and the cover to prevent the formation of a vacuum between the cover and the base mounting surface without providing an externally accessible opening between the cover and base, the channel end portion being unobstructed by the cover when in positon against the base mounting surface.

* * * * *